United States Patent [19]

Vauss, Jr. et al.

[11] Patent Number: 4,657,650

[45] Date of Patent: Apr. 14, 1987

[54] ELECTROCHEMICAL CELL HAVING RETICULATED ELECTRICAL CONNECTOR

[75] Inventors: Elvin M. Vauss, Jr., Cleveland; Andrew J. Niksa, Concord, both of Ohio

[73] Assignee: Eltech Systems Corporation, Boca Raton, Fla.

[21] Appl. No.: 623,837

[22] Filed: Jun. 22, 1984

Related U.S. Application Data

[63] Continuation-in-part of Ser. No. 617,489, Jun. 8, 1984, abandoned. filed as PCT US83/01926 on Dec. 8, 1983, published as WO84/02615 on which is a continuation-in-part of Ser. No. 453,573, abandoned.

[51] Int. Cl.[4] ..... C25B 9/04

[52] U.S. Cl. ..... 204/242; 204/253; 204/267; 204/279

[58] Field of Search ..... 204/279, 284, 283, 253–258, 204/267–269, 242, 288–289; 361/408; 339/DIG. 3; 174/126 R, 133 R, 94 S, 94 R

[56] References Cited

U.S. PATENT DOCUMENTS

| | | | |
|---|---|---|---|
| 1,743,888 | 1/1930 | Hamister | 174/94 R X |
| 3,419,844 | 12/1968 | Schmued | 339/48 |
| 3,423,243 | 1/1969 | Kordesch et al. | 136/86 |
| 4,108,752 | 8/1978 | Pohto et al. | 204/256 |
| 4,336,124 | 6/1982 | Gerard et al. | 204/284 |
| 4,345,986 | 8/1982 | Korach | 204/283 X |
| 4,350,580 | 9/1982 | Kadija | 204/279 |
| 4,410,410 | 10/1983 | Deborski | 204/288 X |
| 4,464,242 | 8/1984 | Boulton | 204/253 |
| 4,468,311 | 8/1984 | de Nora et al. | 204/283 X |

FOREIGN PATENT DOCUMENTS

| | | |
|---|---|---|
| 428329 | 6/1911 | France . |
| 1399157 | 4/1965 | France . |
| 2019289 | 10/1979 | United Kingdom . |
| 2056493 | 5/1981 | United Kingdom . |

*Primary Examiner*—Donald R. Valentine
*Attorney, Agent, or Firm*—John J. Freer

[57] ABSTRACT

An arrangement for an electrical connector is disclosed comprising a first conductor member, an oppositely spaced second conductor member, a reticulated electrical interface therebetween, and means for fastening together the first and second members and the reticulated electrical interface. In one embodiment the arrangement comprises a high current bus connector. In another arrangement an electrolytic cell is provided. The reticulated interface comprises a network of open-pore cells constructed of an electrically-conductive material. The arrangement is preferably assembled such that the reticulated network is compressed between the first and second conductor members to deform and mateably engage the members for close, current-communicative cooperation therebetween. In another embodiment of the present invention, the reticulate interface material includes side wall portions having a plurality of reticulate edge points on the side wall surfaces. In accordance with another aspect of the present invention, the reticulate interface material is corrugated with ridges and grooves. A variation of the corrugation includes bumps or raised projections, which may alternate with depressions or dimples.

4 Claims, 9 Drawing Figures

TITLE: INTERFACE MATERIAL 1/8", 7.5g/in³ Ni LOADING

ELECTROCHEMICAL CELL HAVING RETICULATED ELECTRICAL CONNECTOR

BACKGROUND OF THE INVENTION

This application is a continuation-in-part of applicants' parent copending U.S. patent application Ser. No. 617,489, now abandoned which was completed in the U.S. Patent Office June 8, 1984, and which derives priority as having been a designated State of Applicants' PCT application No. U.S. 83/01926, filed in the U.S. PCT receiving office on Dec. 8, 1983. PCT application No. U.S. 83/01926 which is a continuation-in-part of U.S. patent application Ser. No. 453,573, abandoned which was filed in U.S. Pat. Office on Dec. 27, 1982. The disclosure of U.S. patent application Ser. No. 617,489 is incorporated herein by reference.

The invention here pertains to the art of electrical current connection devices and more particularly to devices which conductively connect one conductor to another and which require a relatively low resistance connection or joint. The invention relates particularly to interface materials for conducting electricity in connections or joints, as distinguished from membranes or diaphragms for electrical conduction of solutions.

The invention is particularly applicable to two types of electrical connector devices. The first type of device comprises a high current density bus connector. The second type comprises a low current density connector. The high current density bus connector is commonly used in power distribution systems to connect sections of bus work together or to connect bus work to equipment. The low current density device typically comprises a joint connection over a relatively large surface area such as where only low joint pressure is available. A low current density joint occurs in current conduction and distribution from a current distributor member to an electrode in an electrolytic cell. However, it will be appreciated to those skilled in the art that the invention could be readily adapted for use in other environments as, for example, where similar connector devices are employed to provide substantially even electrical communication with low resistance and low voltage drop across the connection.

The resistance and therefore the voltage drop across any electrical joint or connection is made up of two components, contact resistance and streamline effect. The contact resistance is dependent upon the actual contact area of the connection, the materials of the opposed conductors to the connection, including oxide layers, and the force applied to the joint. When two rigid connectors are mated together, it is well known that they contact in only a small portion of the total overlap area due to high and low points on each conductor. In addition, the points of actual contact are relatively few. The increase in resistance caused by the current funneling from the gross area through the constriction of the contact area is referred to as streamline effect. Obviously, the resistance of the connection is increased according to the increase in the streamline effect.

Conventional high current density bus arrangements generally comprise a pair of opposed electrical conductors which are fastened together typically by a fastening means, such as a bolt and nut assembly. It is not uncommon for a bus connection to handle thousands of amps of current. To maintain a low voltage drop across the bus joint with such a high level of current it is necessary to maintain a very low resistance across the joint. The resistance may be maintained at a low level by (1) increasing the gross area of the joint which thereby increases actual contact area, (2) increasing the force on the joint to compress the conductors so that more points and area are in contact, (3) removing oxide layers from contact areas and preventing new oxide layers from forming and/or, (4) machining the conductors to improve mating and actual contact area. These items alone or in combination will improve the joint resistance, but with the cost of more material, larger fasteners, machining and costly cleaning. Even with these improvements, the contact points are random and few so that a streamline effect penalty is still incurred.

In the case of low current density joint arrangements, large joint pressures are not available. In order to maintain a low voltage drop, the area of the joint is made much larger. Because the contact resistance is dependent upon joint pressure, the specific contact resistance, i.e., contact resistance for a unit area, will increase. However, because the area has been increased, the current flowing through the unit area has been reduced, thus the voltage drop may be maintained at a low level. In addition, the current is evenly distributed over a large area which may be a benefit as in the case of connection from a current distributor member to an electrode in an electrolytic cell. What is difficult to achieve in the low current density joint arrangement is the creation of many evenly distributed areas of contact between the two conductors, and more importantly low pressure.

One known solution for some of the above identified problems for both the high current density and low current density connection is the use of an interface material, which is a deformable conductive material placed between the opposing conductors, known as MULTILAM TM (a registered trademark of Multilam, Inc.). This material increases the number of contact points, thus ensuring a good distribution of contact points and reducing contact resistance and streamline effect. This material is described in Multilam Corporation's U.S. Pat. No. 4,080,033 and U.S. Pat. No. 3,861,776. The MULTILAM TM conductive material is comprised of a series of spring louvers which give the material the ability to deform and insure contact. A particular disadvantage with the MULTILAM material is the high cost of the material and production. Also, the amount of compression must be controlled which usually requires expensive machining of the conductor faces. Another problem is lack of ability easily to conduct or to transfer heat away from the joint.

STATEMENT OF THE INVENTION

Tne present invention contemplates a new and improved electrical connector construction whicn significantly overcomes all of the above mentioned problems and other problems to provide a new cell connector arrangement which is simple in design, economical to manufacture, readily adaptable to existing bus connections, easy to construct, easy to maintain, has better heat conduction, works in both low pressure and high pressure joints, does not require machining of conductors (terminals), and may be employed in both high and low current density joint arrangements.

Therefore, the present invention provides for an electrical interface material for communication of electrical current between first and second opposed conductor members comprising an interface consisting essentially of a compressible continuously reticulated network of openly porous electrically conductive strands, said interface having side wall portions in mating engagement with said first and second conductor members.

Also, the present invention provides for an electrolytic cell comprising electrode assemblies, a current distributor, means for mechanically maintaining the current communicative cooperations, and the continuously reticulated electrical interface of the paragraph above, wherein the interface is compressed between an electrode assembly and said current distributor member, or compressed between two electrode assemblies, with multiple point contact respectively between the mating faces of the reticulated interface and the electrode assemblies.

The present invention also provides for an electrical connection arrangement of the type comprising first and second opposed conductor members having a conductive interface material pressed in bridging relationship between said conductor members, and means for fastening together said first and second members and said interface, the improvement comprising said interface consists essentially of a continuously openly porous reticulated network of electrically conductive strands which are compressed between the conductor members with multiple point contact between mating faces of the reticulated interface and the conductors.

BRIEF DESCRIPTION OF THE DRAWINGS

The invention may take physical form in certain parts and arrangements of parts, the preferred embodiment of which will be described in detail in the specification and illustrated in the accompanying drawings which form a part hereof and wherein.

GENERAL SUMMARY OF THE INVENTION

Figure 1:
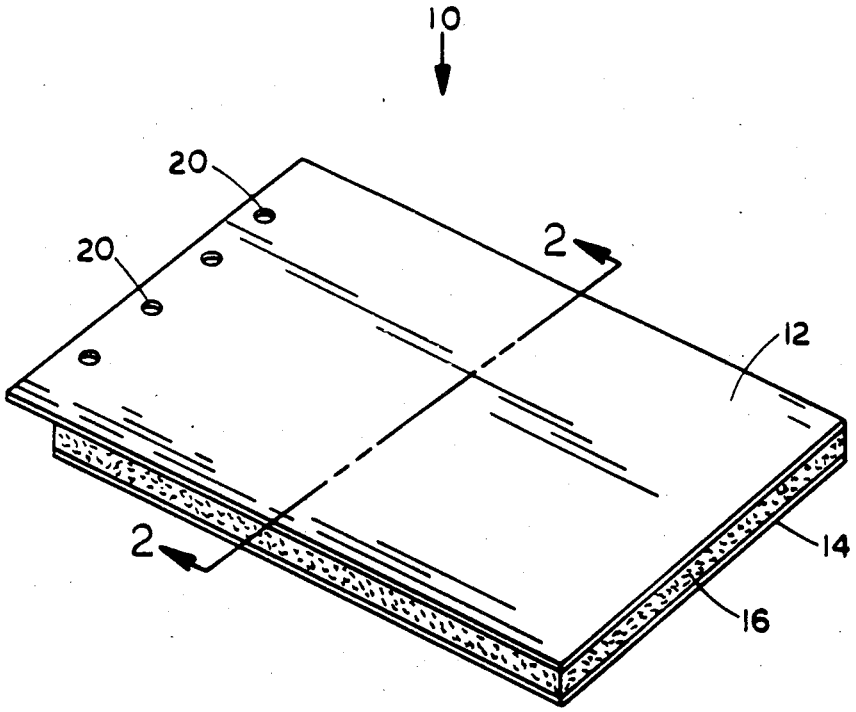
FIG. 1 is a perspective view of an electrical connection arrangement which is formed in accordance with the present invention.

In accordance with the present invention, there is provided an electrical joint arrangement including a conductive reticulated interface material to be interposed between opposing conductors of the connection. The continuously reticulated interface material comprises a network of open pore cells constructed of an electrically conductive material. By "continuously reticulated" is meant the pores interconnect. The reticulated interface material is deformable to engage particularly the conductors and thus increase areas of contact to ensure good distribution of the areas of contact. More particularly, the interface engages the electrode pans or the back plates of the electrode assemblies. Preferably, the reticulated material is comprised of metallurgically bonded conductive metal strands. The material may be used in either high or low current density joints.

In accordance with another aspect of the present invention, the reticulate interface material includes side wall portions having a plurality of reticulate edge points on the side wall surfaces. Because the points have high contact pressure because of their relatively small contact areas, they penetrate surface oxide layers at the surfaces of the conductors to enhance electrical connection.

In accordance with another aspect of the present invention, the side walls of the reticulate interface material have raised portions. In one aspect, these may be corrugation. In other words, the side walls have raised ridges that alternate with grooves, which may be either parallel or random. A variation of this includes that the raised projection are bumps, which may alternate with depressions or dimples.

The raised projections on the interface material are made to deform more easily, that is with less force. Thus, when 2 irregular surfaces are brought together with this interface between, the high points come into contact first. As force is applied, the pressure on the points of contact (the high points) causes them to deform until more points come into contact. As more and more points come into contact, the force required to deform the interface becomes greater. The desired result is to allow enough deformation at relatively low forces to bring many points into contact, thus making many electrical points of contact, even though the surfaces are uneven. After enough points of contact are made, the force will be increased and the bus joint will be complete.

The dimples or raised projections may be of a variety of shapes including cones, pyramids, cylinders, hemispheres, rectangles, et cetera. Any shape may be employed. It is preferred that the projection be symmetrical, but not necessary. Also, it is preferred that the projections be uniformly distributed, but they may be randomly distributed.

The shape of the raised projections may have an effect upon the force required to compress (deform) the projection and upon the area of contact of the projection as it deforms. For example, a cone or pyramid when first in contact requires only a small force to compress it as the tip of a cone or pyramid is weak relative to the base of a cone or pyramid. Also, the initial area of contact of the tip of a cone or pyramid is small. As the cone or pyramid deforms, more and more area comes into contact and the force required to compress it further goes up quickly. Other shapes will have other force and area of contact characteristics which can be used to advantage in controlling the amount of force and contact area.

The size in any direction of a projection and/or a dimple may vary from as small as 0.5 mm to as large as 20 mm, with a preferred size of 2 mm to 7 mm. It is a preferred emoodiment that the height is around 1.5 mm. The arrangement may be in any pattern, or completely random, with spacings from 0.5 mm to 50 mm.

A preferred embodiment is to have 3–4 mm between projections. Depending on projection size, it is beneficial to make the spacing as close as possible so as to create as many points of contact as possible. The projections may be created in the interface material in a variety of ways including forming of the raw foam, machining, pressing, embossings, et cetera.

In accordance with another aspect of the present invention, a sealing means may be provided around the perimeter of the interface material to seal the contact area and prevent corrosive chemicals or environments from oxidizing or corroding the connection. The sealing means may include anti-oxide or corrosion inhibiting grease or compound.

One advantageous feature obtained by use of the present invention is an electrical connection arrangement which provides a relatively low voltage drop, and thus minimum power loss, across the connection. It is also an advantageous feature of the invention that the connection requires less force to make the connection. Another benefit obtained by the use of the present invention is the even distribution of current over the connected conductor surface. Yet another benefit of the present invention is electrical connection which provides improved conduction of heat to the ambient atmosphere of the connection or provides improved conduction of heat into either of the electrically conductive joint members, such as where no atmosphere exposure is available. A major advantage is that close tolerance (machining) of conductors is not necessary. The reticulate also may be made in a variety of materials to suit application environments.

Other benefits and advantages for the subject invention will become apparent to those skilled in the art upon reading and understanding this specification.

DETAILED DESCRIPTION OF THE INVENTION

Referring now to the drawings wherein the showings are for purposes of illustrating the preferred embodiment of the invention only and not for purposes of limiting same, the FIGURES show an electrical connection arrangement comprising a reticulated electrical interface for communication of electrical current between opposed members. The interface comprises a compressible network of a conductive metal.

Figure 2:
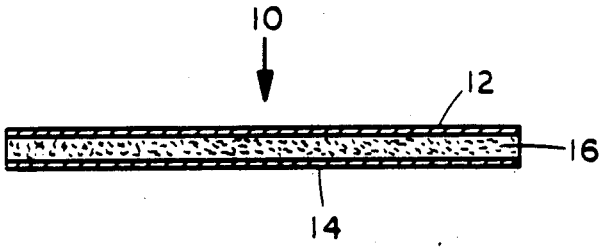
FIG. 2 is a cross sectional view taken along line 2—2 of FIG. 1.

With particular reference to FIGS. 1 and 2, a typical low current density electrical connection 10 as may be used in an electrolytic cell is illustrated. Only a portion of the cell illustrating the connection between the current distributor member 12 and an electrode plate 14 is shown. The electrode plate 14 comprises a first conductor member to the connection 10 and is arranged opposite a second conductor member comprising the current distributor member 12. Both the plate 14 and the distributor member 12 are of substantially the same area. The electrode plate 14 is typically constructed of titanium, nickel, and may be constructed of any other suitable corrosion resistant conductor element. In the cell operation the electrolytes and electrolytic reaction occur on the side of the electrode plate 14, opposite of the current distributor member 12 is preferably made of a highly conductive material, such as, for example, copper, with connecting apertures 20 for connection to an external power source. A reticulated interface material 16 is interposed between the electrode plate 14 and the current distributor member 12 to enhance electrical connection between them and to provide an even distribution of contact area over the surfaces of both the plate and the distributor member.

Figure 3:
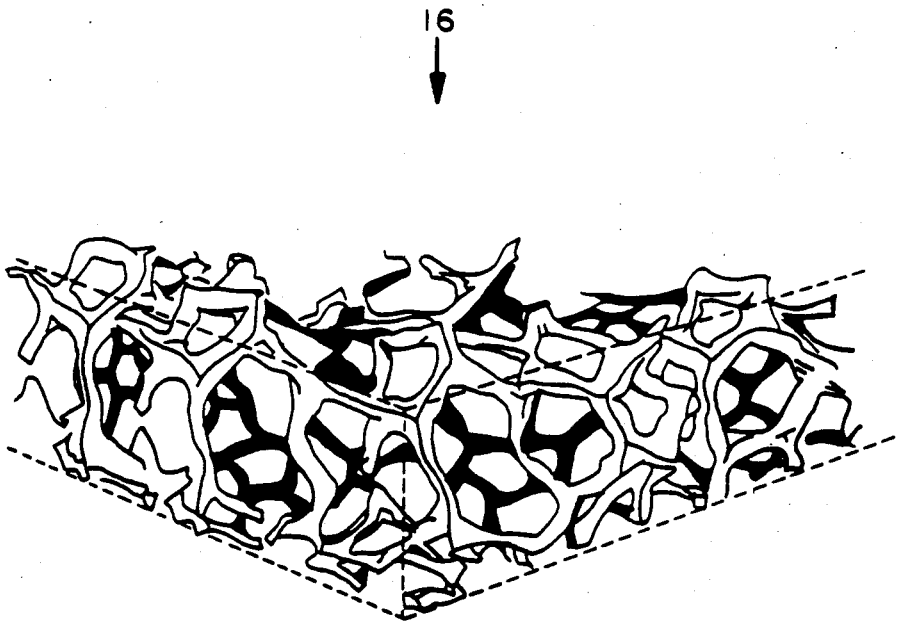
FIG. 3 is an enlarged perspective view in partial section of a reticulated interface material formed in accordance with the present invention.

The interface material 16 is comprised of a network of open pore cells constructed of an electrically conductive material (FIG. 3). Such material may comprise platinum, gold, silver, copper, aluminum, nickel, palladium, and the like.

In assembly, the network is selectively compressed between the plate 14 and the distributor 12 to deform the network such that there is mateable engagement with the contacting surface areas of both the plate and the distributor. In such compression, the network 16 plastically deforms to provide an electrically conductive path between the entire surface area of both the distributor and the plate. In addition, the network penetrates a surface oxide layer at the surfaces of the plate 14 and distributor 12 to enhance electrical connection to these items. The reticulate material includes side wall portions having a plurality of reticulate edge points on the side wall surfaces (FIG. 3) which penetrate surface oxide layers at the surfaces of the conductors upon compression of the joint assembly. The edge points being of relatively small area as compared to the gross area of the joint having a very high pressure (force per unit area) against the conductor thereby reducing contact resistance and penetrating the oxide layer.

In a typical electrolytic cell arrangement according to the instant invention, the thickness of the interface material measured perpendicular to the contact area is preferably between one sixty-fourth and one-half of an inch (0.04–1.27 cm) and more preferably between one thirty-second and one-fourth of an inch (0.079–0.635 cm). In operation, the plate and distributor are subjected to a low pressure of 0.5–100 psi (0.035–7.03 kg/cm$^2$), and preferably 1–20 psi (0.070–1.406 kg/cm$^2$) over the electrode and plate surfaces to provide the force to deform the interface material 16 and insure the low voltage loss joint. This pressure is defined as "average" or over the gross area, i.e. force/gross joint area, as opposed to actual contact pressure on the points. Based on gross area of contact, current density for such a joint arrangement is preferably less than one hundred amps per square inch (15.5 amps/cm$^2$) and more preferably less than twenty-five amps per square inch (3.875 amps/cm$^2$).

Figure 4:
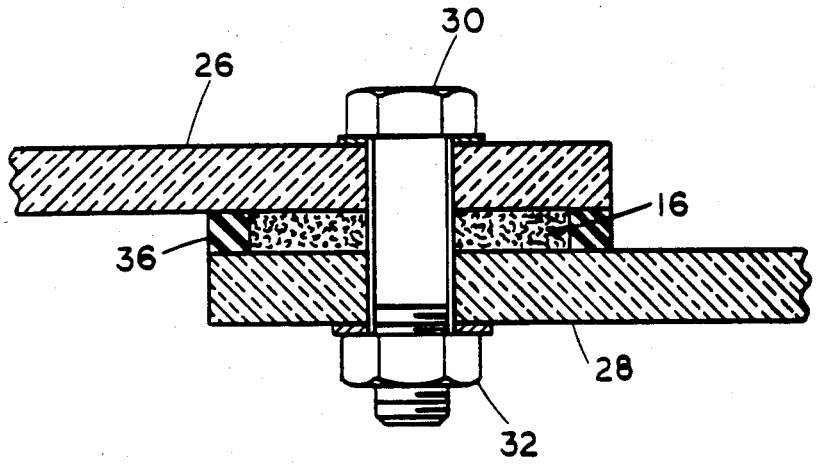
FIG. 4 is a cross-sectional view of an electrical connection arrangement such as may be employed for a high current density bus connection formed in accordance with the present invention.

With particular reference to FIG. 4, a typical high current density bus connection arrangement 24 is illustrated. The bus arrangement comprises a first conductor member 26 and an oppositely spaced second conductor member 28 at least aligned in partial overlap with the first conductor member. The conductor members 26, 28 preferably comprise a highly conductive current carrier such as copper or aluminum to carry high levels of current. Conductor members 26,28 are fastened or connected by a fastening means such as a bolt 30 and nut 32 assembly to maintain contact areas for electrical communication between members and provide the force to deform the reticulated interface material 16. The reticulated interface material 16 is disposed between the conductor members 26, 28 to provide an improved electrical connection between the members. Upon tightening of the bolt and nut assembly the reticulated interface material 16 is deformed to provide a great number of points of contact evenly distributed over the contact surface of conductor members 26,28. Such an arrangement provides lower resistance and voltage loss due to greater area of contact, even distribution of contact resulting in a reduced streamlined effect, and penetration of surface oxide layers by points on the reticulated interface material 16. Sealing gasket 36 may be optionally provided and is disposed peripherally about the reticulated interface material between the conductor members 26,28 to prevent entrance of corrosive or oxidizing elements to the contact area.

High current density joint arrangements as illustrated in FIG. 4 may handle current densities as high as desirable and are only limited by voltage loss and cooling requirements of the joint. The reticulate interface material 16 provides improved conductivity of heat generated in the joint to atmosphere where no sealing gasket 36 is provided. Where sealing gasket 36 is provided in the arrangement, the reticulate material 16 provides improved conductivity of heat into either of the joint conductor members 26,28. Most high current density bus connections are either air cooled and in particularly high current arrangements, the joint can even be water cooled.

Figure 5:
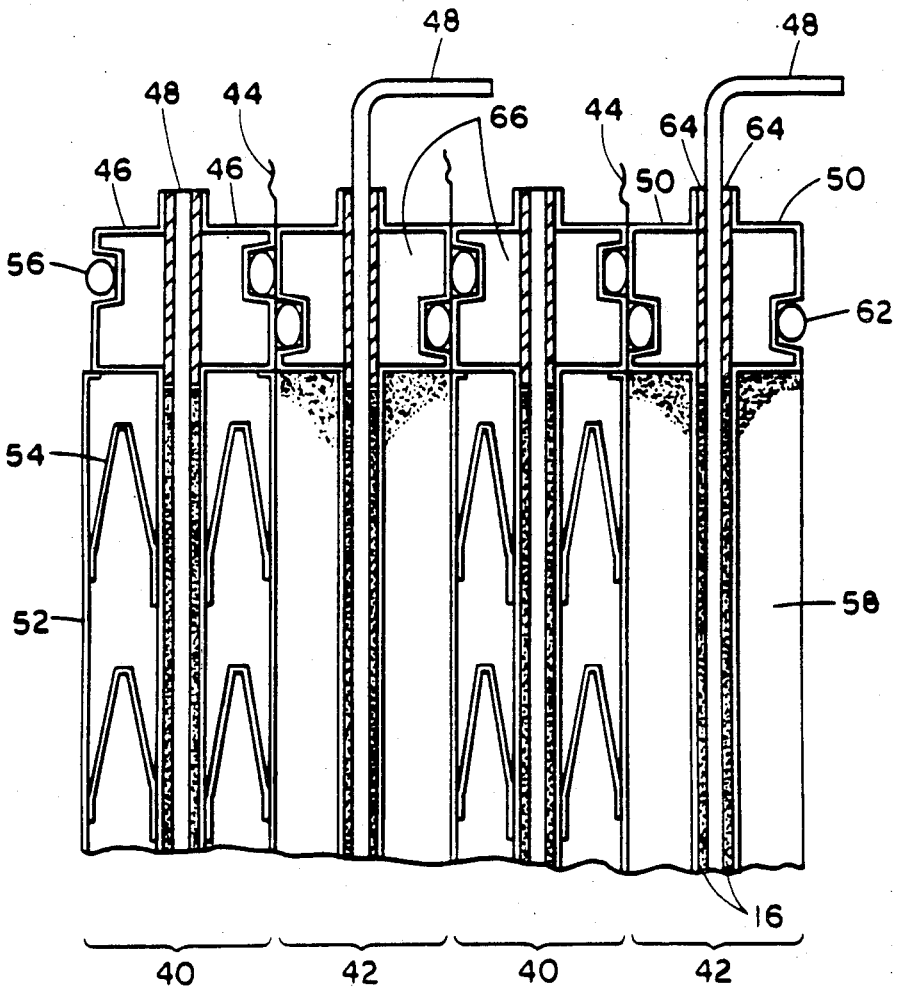
FIG. 5 is a plan view in partial cross section of an electrolytic cell including an electrical connection arrangement formed in accordance with the present invention.

FIG. 5 illustrates an embodiment of the present invention as it relates to electrolytic cell construction. The figure shows an assembly consisting of a plurality of vertically disposed anode assemblies 40 and cathode assemblies 42 in physical contact with permselective membranes 44. Anode pans 46 are located on either side of the current distributor member 48. Likewise cathode pans 50 are located on either side of current distributor members 48. The anode pans have active anode areas 52 attached to the pans with springs 54 and also include a sealing means 56. Similarly, the cathode pans 50 include active cathode areas 58. Reticulated interface material 16 is interposed between the distributor members 48 and the cathode pans 50 to enhance electrical connection between the distributor members and the pan. The interface material 16 includes substantially the same surface area as the opposed cathode pan 50 and the current distributor member 48. This type of electrical connection arrangement is similar to that more particularly illustrated in FIGS. 1 and 2 and comprises a low pressure joint connection. Sealing means 62 are provided for sealing of the cathode pans. The anode and cathode assemblies are alternated and are in contact with and separated by membranes 44. Spacers 64 are utilized as is necessary to maintain proper cell dimensions. Grouting material 66 for making the pans more rigid may also be employed.

Figure 6:
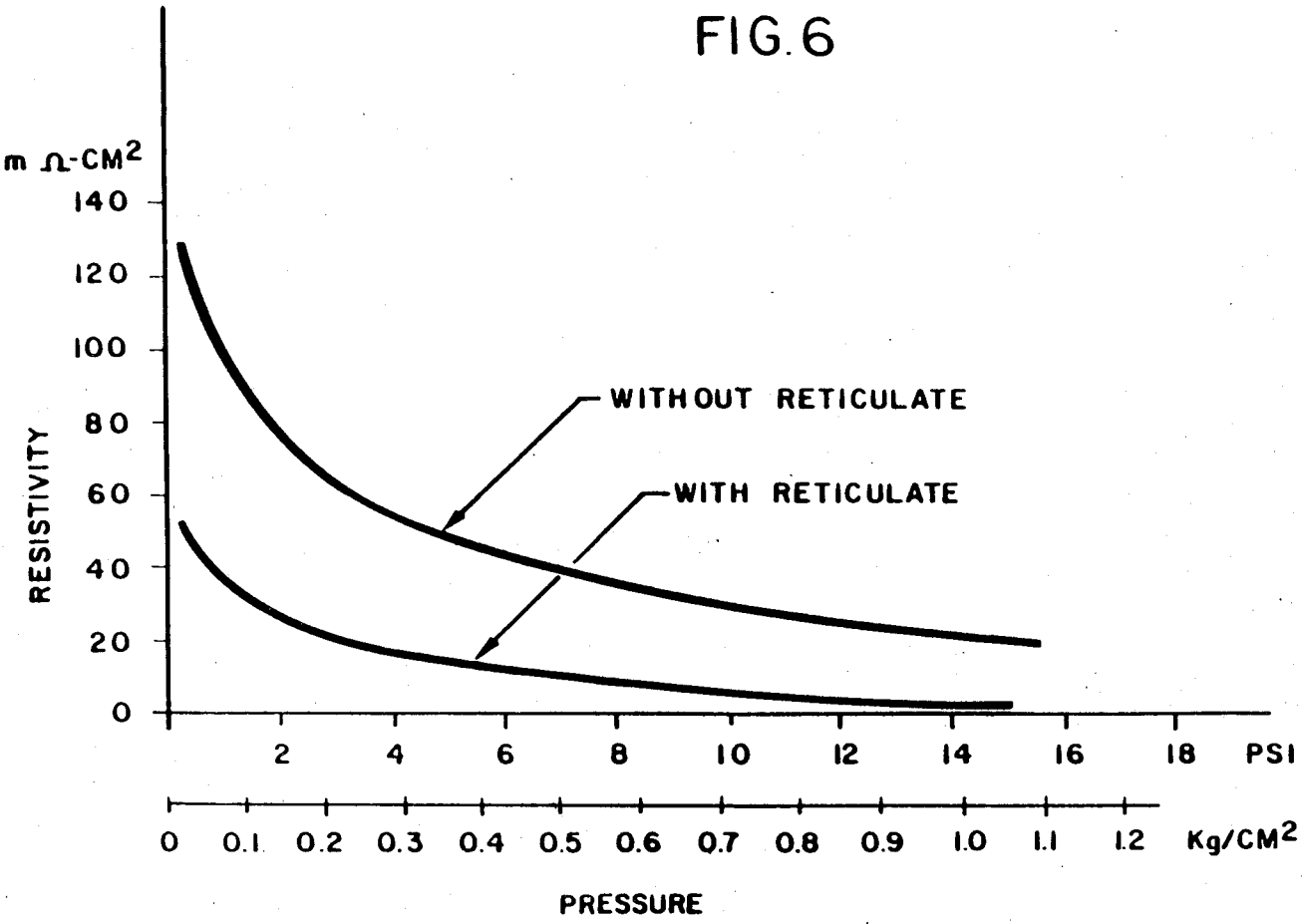
FIG. 6 is graph 1 illustrating the effect of a nickel reticulate interface on a titanium to copper joint as compared to the same joint without the interface was determined.

FIG. 6 is Graph 1 illustrating the reticulate material of Example I as compared to joint without any interface. The material used as an interface was nickel, and has 7 pore per inch (per 2.54 cm) pore size and a metal loading of about 6 grams/cubic inch (0.366 g/cm$^3$). The results are plotted on Graph 1 as specific contact resistance in ohms-centimeters squared (( )-cm$^2$) versus average contact pressure in kg/cm$^2$. The graph shows consistently lower resistances throughout the pressure range tested using the reticulate in the copper-titanium joint.

Figure 7:
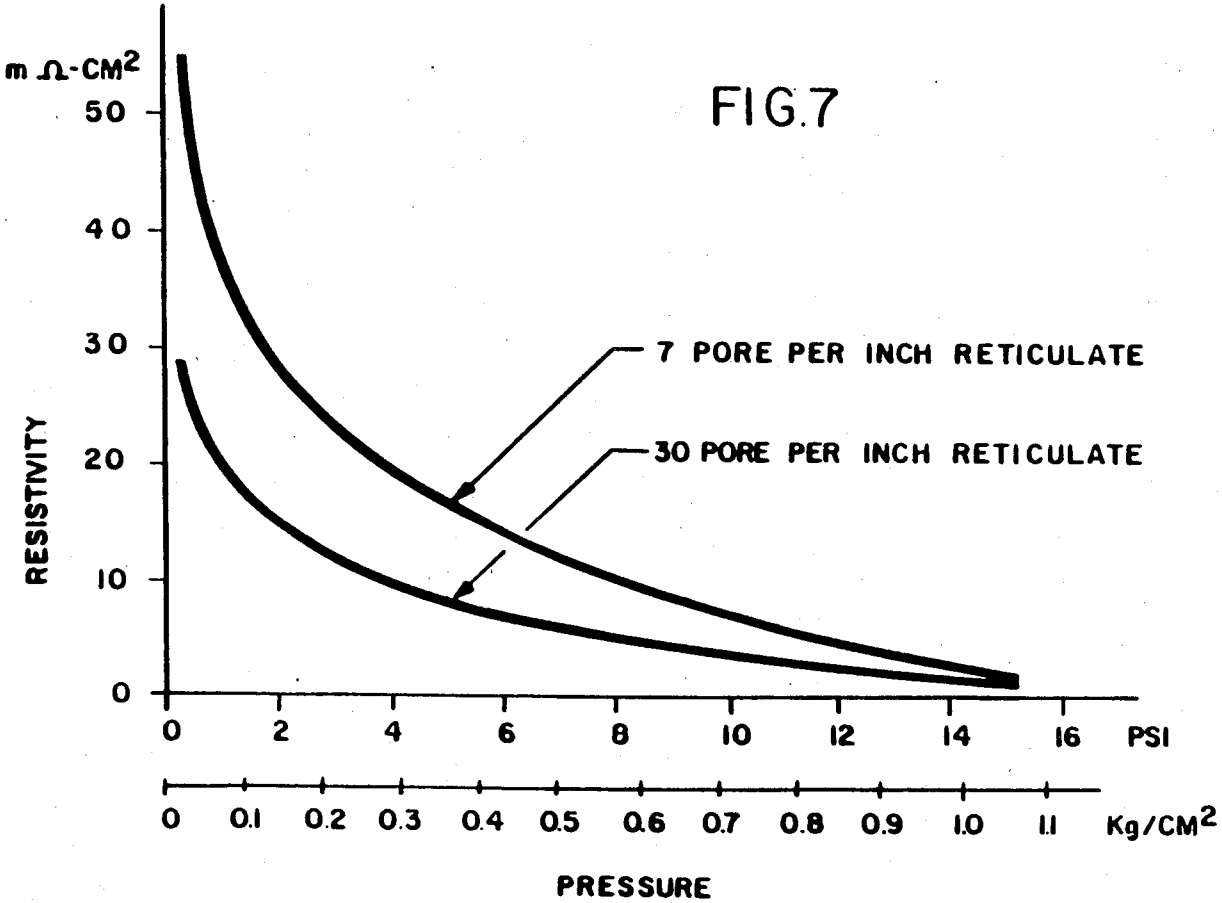
FIG. 7 is graph 2 illustrating the effect of pore size in the reticulate interface. Two tests were conducted with a titanium/copper joint.

FIG. 7 is Graph 2 illustrating Example II. Two tests were conducted with a titanium/copper joint. One test used a 7 pore per inch (2.54 cm) nickel reticulate interface material and the second test used a 30 pore per inch (2.54 cm), nickel reticulate interface material. The joint area was 0.49 square inches (3.16 cm$^2$). The finer pore reticulate (30 pore per inch) shows lower resistance throughout the pressure range tested than the 7 pore per inch material. The improvement is due to higher number and more closely spaced points of contact between the reticulate and the titanium and copper.

Figure 8:
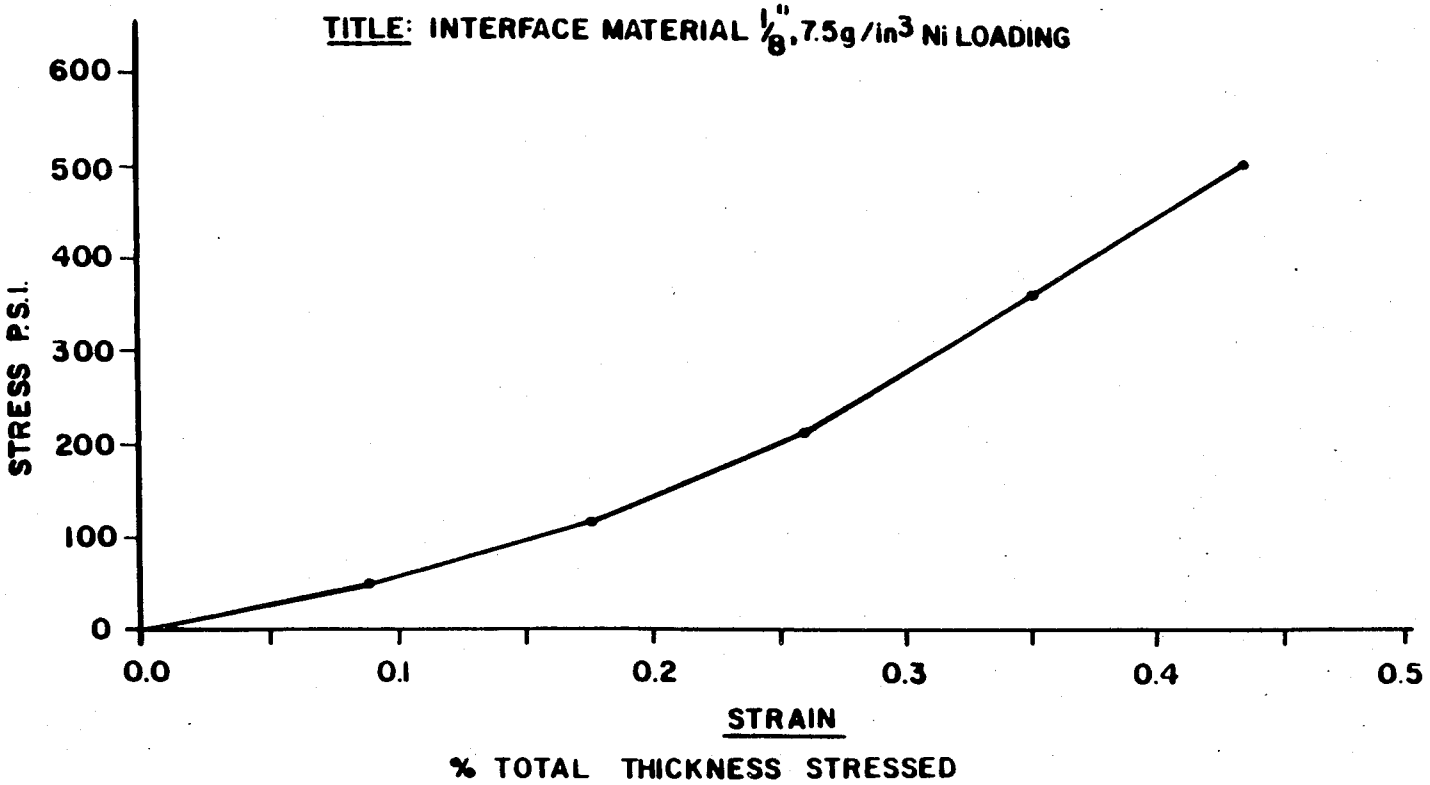
FIG. 8 is graph 3 illustrating the measurement of the stress versus strain ability of an interface material of ⅛ inch, with 7.5 g/cubic inch nickel loading.

FIG. 8 is Graph 3 illustrating the measurement of the stress versus strain ability of an interface material of $\frac{1}{8}$ inch, with 7.5 g/cubic inch nickel loading.

Figure 9:
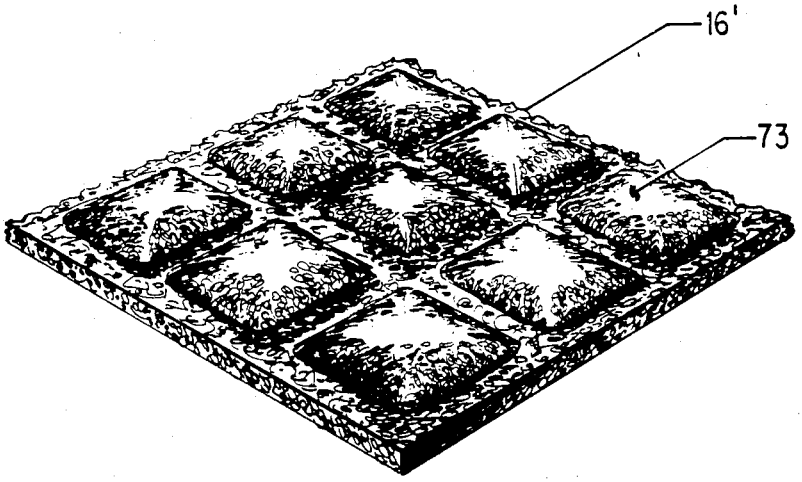
FIG. 9 is an enlarged perspective view in partial section of a reticulated interface material 16' with the variation of having projections 73 formed in accordance with an embodiment of the present invention.

FIG. 9 is an enlarged perspective view in partial section of a variation of a reticulated interface material 16' which employs raised projections 73. The projections can alter the amount of force required to deform the interface to allow more points of contact. The projections may be a variety of shapes including, but not limited to, pyramids, cones, cylinder, rectangles, et cetera.

From the foregoing, it is readily apparent to those skilled in the art that the instant invention finds use in numerous situations where good electrical contact is required between juxtapositioned conductors.

The invention has been described with reference to the preferred embodiment. Obviously, modifications and alterations will occur to others upon the reading and understanding of the specification. It is our intention to include all such modifications and alterations insofar as they come within the scope of the appended claims or the equivalents thereof.

EXAMPLE I

A laboratory apparatus which was capable of applying a known force to a sample joint while passing a known current through the joint was used to determine joint resistances for low pressure joints. The sample joint was made up of disks of metal with a joint area equal to 0.49 square inches (3.16 cm$^2$). The tests were conducted by applying joint pressures (average joint pressure calculated by total joint force divided by gross joint area) which varied from 0.5 psi to 18 psi (0.035 kg/cm$^2$ to 1.27 kg/cm$^2$) while passing one amp of direct current through the joint and measuring the voltage drop across the joint. The joint resistance was then calculated based on ohms law.

In this example the effect of a nickel reticulate interface on a titanium to copper joint, compared to the same joint without the interface was determined, as illustrated by Graph 1 in FIG. 6. Both copper and titanium surfaces were clean and free of oxide layers. The reticulate material used as an interface was nickel, and has 7 pore per inch (per 2.54 cm) pore size and a metal loading of about 6 grams/cubic inch (0.366 g/cm$^3$). The results are plotted on Graph 1 as specific contact resistance in ohms-centimeters squared ($\Omega$-cm$^2$) versus average contact pressure in kg/cm$^2$. The graph shows consistently lower resistances throughout the pressure range tested using the reticulate in the copper-titanium joint.

EXAMPLE II

A laboratory apparatus and test procedure as described in Example I were used.

In this specific example the effect of pore size in the reticulate interface material is illustrated. Two tests were conducted with a titanium/copper joint, as illustrated by Graph 2 in FIG. 7. One test used a 7 pore per inch (2.54 cm) nickel reticulate interface material and the second test used a 30 pore per inch (2.54 cm), nickel reticulate interface material. The joint area was 0.49 square inches (3.16 $cm^2$). The finer pore reticulate (30 pore per inch) shows lower resistance throughout the pressure range tested than the 7 pore per inch material. The improvement is due to higher number and more closely spaced points of contact between the reticulate and the titanium and copper.

EXAMPLE III

The stress versus strain ability of an interface material of ⅛ inch, with 7.5 g/cubic inch nickel loading was measured, and is illustrated by Graph 3 in FIG. 8.

EXAMPLE IV

This example shows a comparison between high pressure, high current density copper to copper joints using copper reticulate interface material and using no interface material. Two of the subject joints were operated side by side in a chlor-alkali cell room bus circuit. Each connection was made up of two rigid, machined, flat copper plates with a gross contact area of about 15.5 square inches, 4"×4" with a 13/16" diameter hole (99.98 $cm^2$, 10.16 cm ×10.16 cm with a 2.06 cm diameter hole) and a compressing force applied to each joint by one ¾ inch (0.318 cm) diameter nut and a bolt tightened with 150 foot-pounds of torque. One joint used a ⅛ inch thick 20 pore per inch copper reticulate interface material placed between the two copper plates, and the second joint used no interface material. A direct current of 4650 amp was passed through each joint (300 ASI current density) (46.5 amps/$cm^2$) and the voltage drop across each joint was measured. The joint with the copper reticulate interface material had a voltage drop of 1.7 mV while the joint without the interface material had a voltage loss of 2.5 mV.

EXAMPLE V

This example shows the ability of the interface material to conform to uneven surfaces and make a good electrical connection therebetween in high pressure, high current density joints eliminating the need for costly machining. Four joints were made between two rigid copper surfaces with gross contact area of about 15.5 square inches 4"×4" with a 13/16" diameter hole (99.98 $cm^2$, 10.16×10.16 cm with a 2.06 cm diameter hole). The surface of the copper was rough and uneven as received from the mill, and intentionally not machined. Because of the uneven joint surface a suitable low resistance joint could not be made without the use of interface material. The joints were assembled using a ⅛" (0.318 cm) thick, 20 pore per inch copper interface material and a ¾ inch diameter bolt and nut tightened to 150 foot-pounds torque to provide the compressive force on the joints. A direct current of 4650 amps (300 ASI) (46.5 amps/$cm^2$) was passed through each joint and the voltage loss measured. The voltage loss across each joint varied from 0.8 mV for the lowest joint and 1.7 mV for the highest.

These joints were successfully made with the use of interface reticulate because the interface reticulate conforms to both uneven surfaces providing points of contact evenly distributed over the gross contact area of both conductors.

EXAMPLE VI

An interface was made as in Example I, but having substantially conical projections on its surface.

The average diameter of the base of a cone was about 2 mm and the height was about 1.5 mm. The average distance between projections was 3–4 mm.

The initial area of contact of the tip of a cone is small. As the interface is compressed between two surfaces and deforms, more and more area comes into contact and the force required to compress it further goes up quickly.

We claim:

1. An electrolytic cell comprising electrode assemblies, a current distributor, means for mechanically maintaining the current communicative cooperations, and a continuously openly porus reticulated electrical interface of electrically conductive strands having pore size ranging from 5 pores per inch to 80 pores per inch and having strands constructed of at least one conductive metal selected from platinum, gold, silver, cooper, aluminum, nickel, palladium, or combinations thereof, wherein the interface is compressed between an electrode assembly and said current distributor, or compressed between two electrode assemblies, with there being side wall portion raised projection multiple point contact between the mating faces of the reticulated interface and the electrode assemblies, and with there being a sealing means disposed peripherally about said reticulated interface to seal said interface.

2. The electrolytic cell of claim 1, wherein the shape of the raised projections is substantially pyramidal, conical, cylindrical, hemispherical, rectangular, or combinations thereof.

3. The electrolytic cell of claim 1, wherein the sized of a projection in any direction is from 0.5 mm–20 mm.

4. The electrolytic cell of claim 3, wherein the arrangement of the projections is in any pattern or completely random, wherein the spacing between projections is from 0.5 mm–50 mm.

* * * * *